US005534979A

United States Patent [19]

Ide

[11] Patent Number: 5,534,979

[45] Date of Patent: Jul. 9, 1996

[54] IMAGE FORMING APPARATUS

[75] Inventor: Fumito Ide, Zama, Japan

[73] Assignee: Kabushiki Kaisha Toshiba, Tokyo, Japan

[21] Appl. No.: 201,375

[22] Filed: Feb. 24, 1994

[30] Foreign Application Priority Data

Mar. 19, 1993 [JP] Japan ..... 5-059779

[51] Int. Cl.[6] ..... G03G 21/00

[52] U.S. Cl. ..... 355/208; 355/246

[58] Field of Search ..... 355/208, 246

[56] References Cited

U.S. PATENT DOCUMENTS

| | | | |
|---|---|---|---|
| 4,742,370 | 6/1988 | Murakami et al. | 355/246 |
| 4,901,115 | 2/1990 | Nakamura et al. | 355/246 |
| 4,999,676 | 3/1991 | Mouri | 355/246 |
| 5,012,286 | 4/1991 | Kawano et al. | 355/246 |
| 5,043,764 | 8/1991 | Arnold et al. | 355/208 |
| 5,166,730 | 11/1992 | Urabe | 355/208 |

FOREIGN PATENT DOCUMENTS 62-177564 8/1987 Japan .

*Primary Examiner*—Nestor R. Ramirez
*Attorney, Agent, or Firm*—Foley & Lardner

[57] ABSTRACT

A developing device incorporated into a copying machine of the present invention has a developer/toner supplying section in which a developing tank and a toner cartridge are independently and detachably formed. A toner density sensor for controlling toner density of developer is provided in the developing device. The toner density sensor is used to detect a developer drawing defect and maintain a predetermined value of toner density during the copying operation when developer is supplied from the developer/toner supply section.

12 Claims, 7 Drawing Sheets

IMAGE FORMING APPARATUS

BACKGROUND OF THE INVENTION

1. Field of the Invention

The present invention relates to an image forming apparatus which converts an image on a document to an electrostatic latent image by an electrostatic image forming process and develops the latent image through toner, and outputs a toner image on a sheet material.

2. Description of the Related Art

An image forming apparatus, for example, a copying machine includes a reading section for reading an object to be copied, that is, image data on a document, an image forming section for a copy image based on image data read by the reading section, and a paper feeding section for feeding transferring material on which the image formed by the image forming section is recorded, that is, a copy paper.

The reading section has a document table on which a document is mounted, and reads the image of the document as image data to be transmitted to the image forming section.

The material transporting section has material cassettes, which contain sheet materials, and a multi-feeder, which can feed the sheet material having a suitable size as required, and transports the sheet materials to the image forming section.

The image forming section includes a photoconductor on which an electrostatic latent image is formed in accordance with image data to be supplied through the reading section, a developing unit for developing the latent image by supplying toner to the latent image formed on the photoconductor, a transferring unit for transferring the toner image developed by the developing unit to the sheet material from the material transport section, and a fixing unit for fixing the toner image onto the sheet material.

The developing unit including toner for developing the electrostatic latent image and carrier for triboelectrically charging toner. The toner and carrier are mixed with each other, thereby the respective particles are charged to a predetermined polarity, and only toner is supplied to the electrostatic latent image.

The carrier and toner are mixed at a predetermined rate in advance to be used as developer. The developer is introduced into a predetermined position in the developing unit by a serviceman when the copying machine is operated for the first time. Such an introduction of the developer is called as a set-up. If the number of times of such a set-up is increased, there occur problems in which the service cost is increased, and the location where the copying machine is mounted and it surrounding portions become dirty. However, since it is known that qualification (physical property) of the developer is changed by the change of the temperature, the developer is airtightly provided, and the developer and the developing unit, which is generally incorporated into the copying machine, are separately transferred. Due to this, at present, it is indispensable for performing the set-up at the location where the copying machine is provided.

There has been proposed a technique in which the developer is introduced into the developing unit in advance and the entire developing unit is airtightly provided. However, there must be prepared an equipment for airtightly providing the entire developing unit and the structure in which the developing unit can withstand the transport of developer as being sealed. Due to this, there occurs a problem in that the manufacturing cost is increased.

SUMMARY OF THE INVENTION

In consideration of the above-mentioned problem, according to the present invention, there is provided an image forming apparatus, comprising: an image bearing member on which an electrostatic latent image corresponding to image information is formed; means for developing the latent image by supplying toner member onto the latent image formed on the image bearing member; means, supplied from an outer section of the developing means, for carrying the toner member to the latent image on the image bearing member, and the carrying means provides a predetermined potential voltage to the toner member; means, arranged in the developing means, for monitoring a ratio of the carrying means of the developing to the toner member; and means for sensing an amount supplied from the outer section of the carrying means of the developing means based on an output from the monitoring means.

Also, according to the present invention, there is provided an image forming apparatus, comprising: an image bearing member: means for forming an electrostatic latent image on the image bearing member; means, having housing means for containing a developing member in which a carrier member and a toner member are mixed at a predetermined ratio and a first opening for supplying the developing member and a second opening for supplying only the toner member, for developing the electrostatic latent image by supplying the toner member to the image bearing member; means, having detecting means for detecting that a casing contained in the developing member is mounted on the first opening, for leading the developing member into the housing means of the developing means; means, mounted in the housing means of the developing means, for detecting a ratio of the carrier member to the toner member, a presence of the developing member, and whether or not all of the developing member are led to the housing means after the leading means is driven for a predetermined period of time; means for determining the leading means is urged to be driven again based on the result outputted from the detecting means; and means for displaying that a miss leading of the developing members.

Further, according to the present invention, there is provided an image forming apparatus, comprising: means for forming a latent image on an image bearing member; means for applying toner member to the latent image formed on the image bearing member by the forming means and developing the latent image, the developing means having an inlet portion for introducing a developing member having a predetermined mixing ratio between the toner member and carrier member; means for detecting the mixing ratio of the developing member introduced in the developing means; a toner cartridge for adding the toner member stored therein, the toner cartridge being detachablity connected to the developing means; set up made setting means for setting a set up made in which the developing member is introduced; set up mode control means for executing the set up mode when the set up mode setting means is activated, and stopping the set up mode in response to a detection result of the mixing ratio by the detecting means; and toner density control means for controlling a density of the toner member in the developing member, the density control means being operable when the set up made is not designated, and adding the toner member contained in the toner cartridge to the developing member, thus maintaining the density of the toner member of the developing member introduced in the developing means, in accordance with the detection result of the detecting means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

An embodiment of the present invention will be explained with reference to the drawings.

Figure 1:
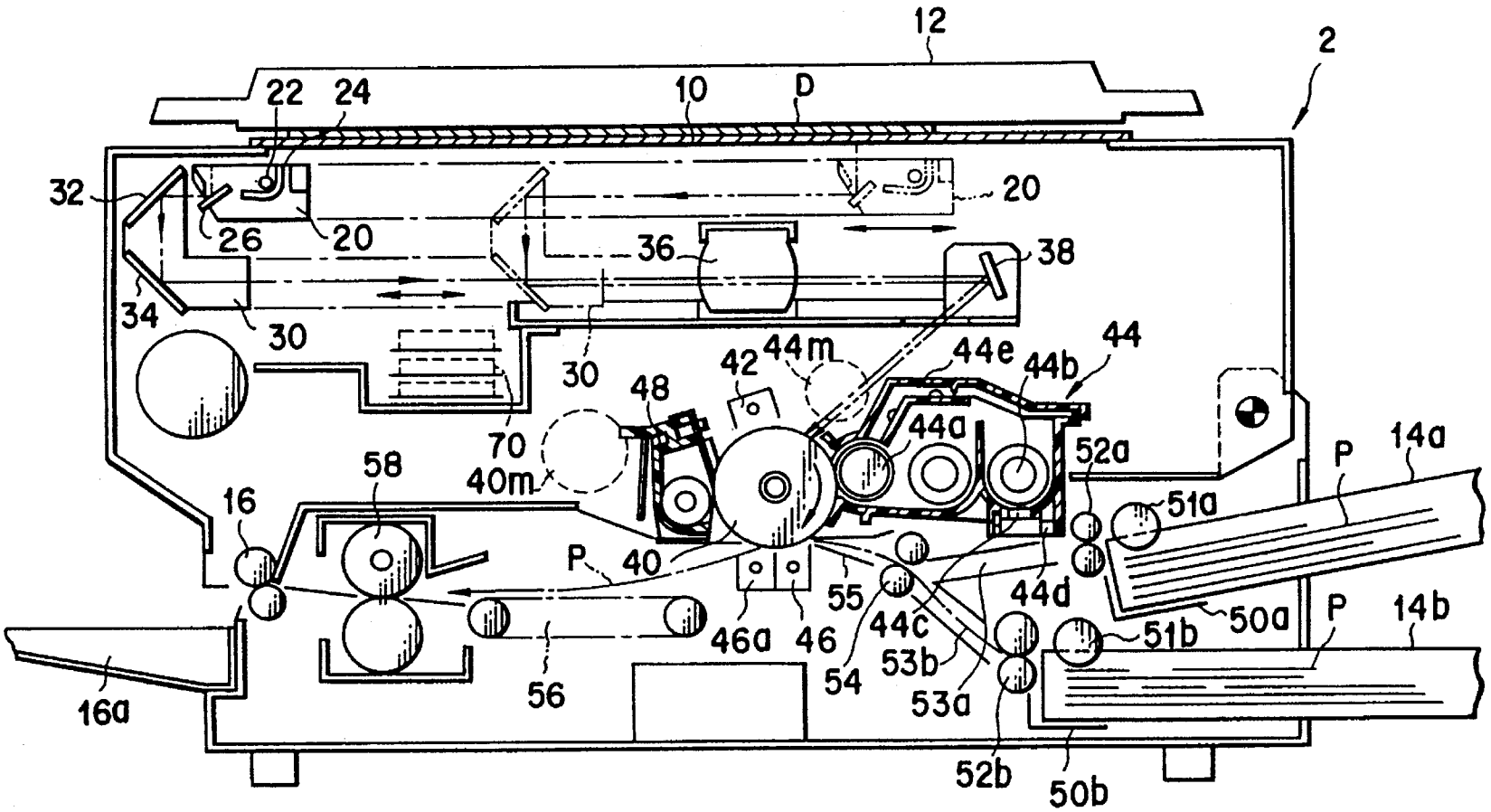
FIG. 1 is a schematic view showing a copying machine in which one embodiment of the present invention is incorporated.

In FIG. 1, an image forming apparatus, i.e., a copying machine 2 includes, on its upper portion, a document table 10 on which a reading object, i.e., document D is mounted, and a document cover 12, which is formed to be closable and openable to the table 10, and the document D mounted on the table 10 is depressed onto the table 10.

In the inner side (lower portion) of the document table 10, there is arranged a first carriage 20 having an illumination lamp 22 and a reflector 24 as one unit. The illumination lamp 22 illuminates the document D mounted on the document table 10. The reflector 24 collects light rays, which are generated from the lamp 22, to the document D. Then, the first carriage 20 picks up reflected light from the document D.

Moreover, a primary mirror 26 is incorporated into the first carriage 20. The primary mirror 26 bends the reflected light sent from the document D, and reflected on a second carriage 30 (to be explained later).

The first carriage 20 is arranged to be movable in parallel with the document table 10. The first carriage 20 is moved in parallel along the document table 10 by a pulse motor (not shown) through a toothed belt (not shown).

At the lower portion of the first carriage 20, there is arranged a second carriage 30 for guiding reflected light, which sent from the document D transmitted through the first carriage 20 to a photoconductive drum (to be explained later).

In the second carriage 30, a secondary mirror 32 and a tertiary mirror 34 are arranged to make a right angle with each other. The secondary mirror 32 and tertiary mirror 34 bend light, which is reflected on the primary mirror 26 of the first carriage 20 and sent from the document D.

The second carriage 30 follows the first carriage 20 by the toothed belt (not shown) for driving the first carriage 20, and is moved in parallel along the document table 10 at a half speed of the first carriage 20.

In the copying machine 2, there are arranged an image-formation lens 36 and a fourthly mirror 38. The image-formation lens 36 is arranged so as to be movable in the plane where the main light beam of the reflected light returned through the tertiary mirror 34 of the second carriage, and provides a focusing property to the reflected light, which is reflected on the tertiary mirror 34 and sent from the document D, and image-forms the reflected light at a predetermined magnification. The fourthly mirror 38 is arranged in the same plane, and returns the reflected light toward a photoconductive drum 40 (to be explained later), and image-forms the reflected light at a predetermined position of the photoconductive drum 40. Also, the fourthly mirror 38 is arranged to be movable in parallel in the same plane so as to correct the variation of the focal distance in accordance with the movement of the lens 36. The image-formation lens 36 and the fourthly mirror lens 38 are moved by a driving mechanism (not shown), respectively.

At the lower portion of the lens 36, that is, in the vicinity of the center of the copying machine 2, there is arranged the photoconductive drum 40 on which a distribution pattern of an electrical charge, i.e., an electrostatic latent image is formed by image-forming the reflected light, which is guided by the fourthly lens 38 and sent from the document D.

A main charging device 42, a developing device 44, a transfer unit 46, and a discharging and cleaning unit 48 are provided around the photoconductive drum 40. In the transfer unit 46, there is arranged a separating (AC charge) unit **46*a* for separating sheet paper on which the toner image is formed from the photoconductive drum 40**.

The main charging device 42 supplies a predetermined electrical charge to the surface of the photoconductive drum 40. The developing device 44 includes toner (not shown) and carrier (not shown). The developing device 44 selectively supplies toner to the electrostatic latent image formed on the photoconductive drum 40, thereby developing the latent image. The transfer unit 46 transfers the toner image to a sheet paper to be supplied by selected cassettes (to be explained later). The discharging and cleaning unit 48 removing the toner and the electrical charge, left on the photoconductive drum 40 after transferring the toner image by the transfer unit 46.

At the back surface of the photoconductive drum 40, there is arranged a main motor **40*m*, which rotates the photoconductive drum 40, the feeding paper roller group, and the fixing unit 58. Also, at the back surface of the developing device 44, there is arranged a developing motor 44*m*, which rotates the developing device 44 at a desired speed. In this case, the developing motor 44*m* may be used as the main motor 40*m***.

A plurality of slots **50*a* and 50*b* to which paper cassettes (to be explained later) is inserted are formed at a right portion of the copying machine 2, that is, between the developing device 44 and the transfer unit 46. Paper cassettes 14***a* and 14*b* are inserted to the slots 50*a* and 50*b* to supply copying paper (sheet paper) to the photoconductive drum 40.

In the inside of the copying machine 2, which is between the photoconductive drum 40 and the cassettes 14*a* and 14*b*, there are arranged first and second paper-supply rollers 51*a* and 51*b*, first and second transfer rollers 52*a* and 52*b*, transfer paths 53*a* and 53*b*, and an aligning roller 54. The first and second paper-supply rollers 51*a* and 51*b* draw sheet paper P one by one from the cassettes 14*a* and 14*b*. The first and second transfer rollers 52*a* and 52*b* transfer sheet paper P, which is drawn from the rollers 51*a* and 51*b* to the photoconductive drum 40. The supply paths 53*a* and 53*b*, which is formed of a pair of guide plates 55, guide sheet paper to the photoconductive drum 40 from the transfer rollers 52*a* and 52*b*. The aligning roller 54 corrects the inclination of sheet paper P, and aligns the top end of the toner image on the photoconductive drum 40 to the top end of sheet paper P.

At the left side of the copying machine 2, which is the position where the sheet paper P to which the toner image is transferred is separated from the photoconductive drum 40 through the transfer unit 46 and transported with the rotation of the photoconductive drum 40, there are arranged a conveyor unit 56, a fixing device 58, a pair of discharging rollers 16, and a discharging tray 16*a*. The conveyor unit 56 transfers sheet paper P to which toner is electrostatically adhered. The fixing device 58 fixes the toner image to the sheet paper P. The pair of discharging rollers 16 discharge the sheet paper P to which the toner image is fixed to the external unit of the machine 2. The discharging tray 16a stocks the sheet paper P discharged through the discharging rollers 16 in order.

Figure 2:
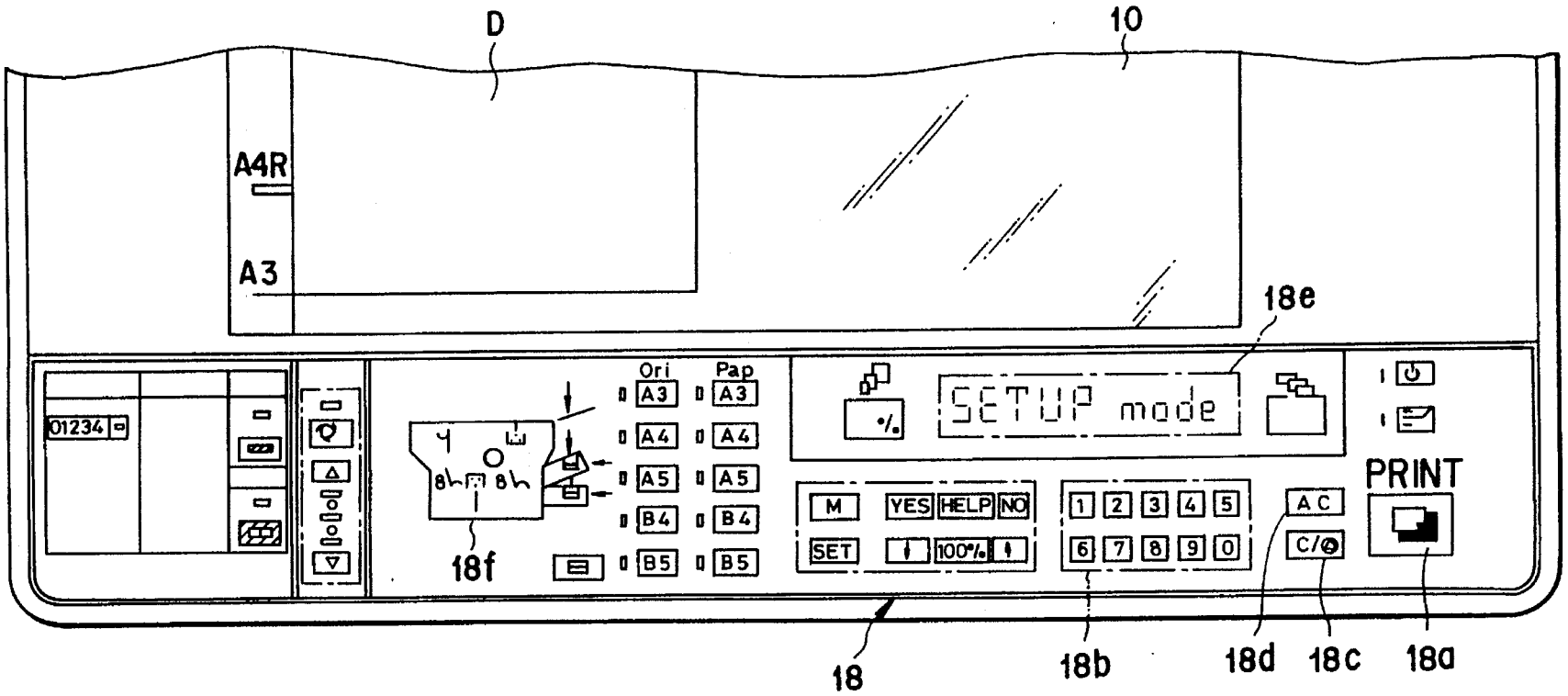
FIG. 2 is a plane view of a console, which is incorporated into the copying machine of FIG. 1.

In FIG. 2, a console panel 18 to which a large amount of data for operating the machine 2 and a print starting signal are inputted by an user, is arranged on the top of the machine 2.

On the console panel 18, there are arranged a print key 18*a*, a numeric key pad 18*b*, a clear key 18*c*, and all clear key 18*d*. The print key 18*a* is used to output the print starting signal. The numeric key pad 18*b* is used to output signals corresponding to numbers 0 to 9 which are used to set a number of paper to be copied or a magnification. The clear key 18*c* is used to stop the copy operation or output data for returning data, which is being inputted, to "0". The all clear key 18*d* is used to return all input data and the operations to the initial state.

Moreover, on the console panel 18, there are arranged a message display section, i.e., a Liquid Crystal Display (LCD) 18*e*, and a monitor LED 18*f*. The LCD 18*f* is used to display inputted data (number of paper to be copied, magnification), an operation procedure of the copying machine 2, timing for supplying copy paper P or toner T, and an error message. The monitor LED 18*f* is used to display the state of the copying machine 2 such as the position of a paper jamming in the selected cassette and the inside of the machine 2.

Figure 3:
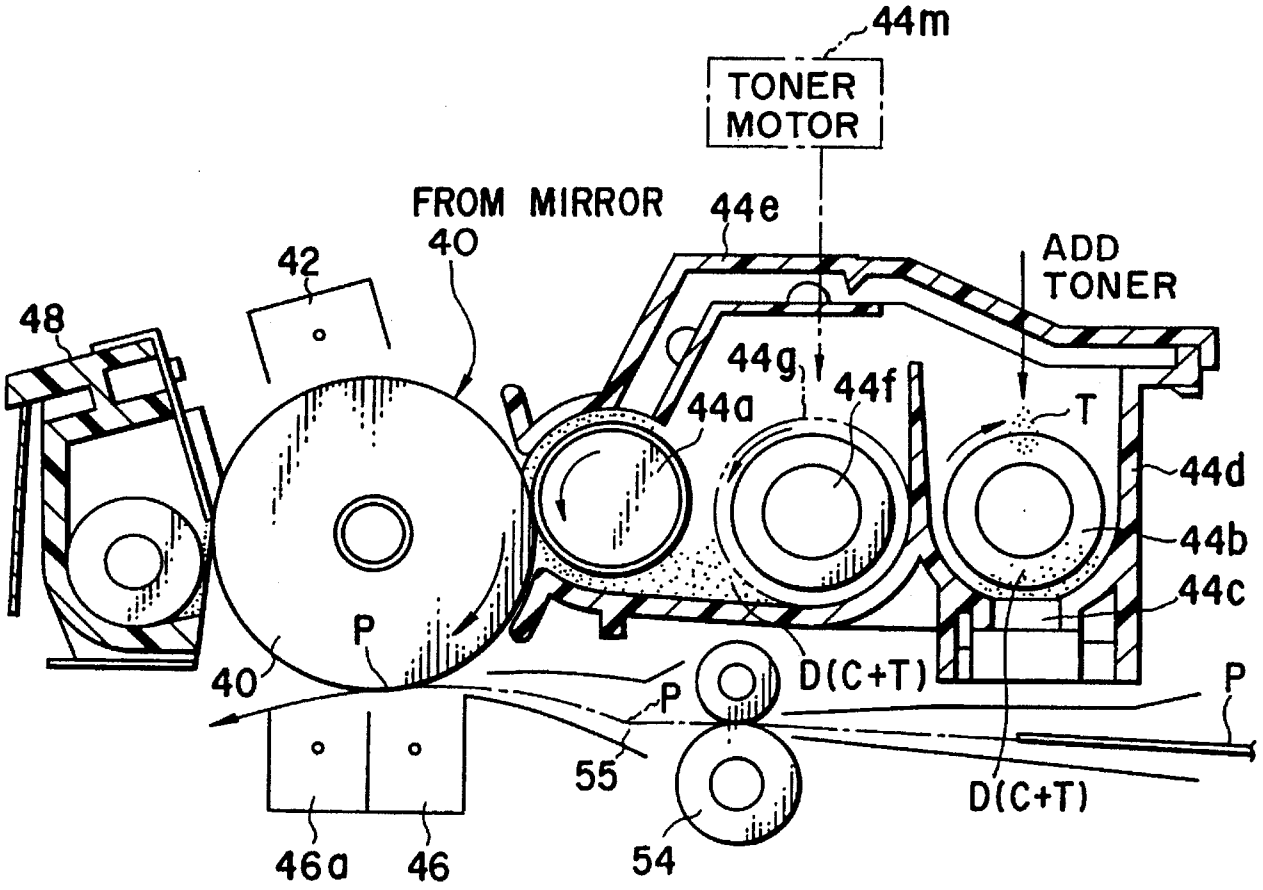
FIG. 3 is a schematic view showing a developing unit which is incorporated into the copying machine of FIG. 1.

In FIGS. 3 and 14, the developing device 44 includes the developing roller 44*a*, a mixing roller 44*b*, a toner density sensor 44*c*, and a housing 44*d*. The developing roller 44*a* transfers the mixture of the carrier C and toner T, i.e., developer D to a developing area formed between the developing device 44 and the photoconductive drum 40, and supplies toner T to the electrostatic latent image formed on the photoconductive drum 40. The mixing roller 44*b* mixes toner T, which is supplied in accordance with toner T consumed when the electrostatic latent image is developed by the developing roller 44*a*, with carrier C. The toner density sensor 44*c* is arranged in the vicinity of the outer peripheral surface of the mixing roller 44*b*, and detects the ratio of toner T to carrier C, i.e., density of toner T in the developer D. The housing 44*d* holds the developing roller 44*a*, mixing roller 44*b*, and toner density sensor 44*c*, and contains the developer D. It is noted that the toner density sensor 44*c* is arranged to be slightly offset at the center of the longitudinal direction of the housing 44*d* and to be able to come in contact with a part of the developer D through an opening (not shown) of the bottom of the housing 44*d*.

At the upper portion of the housing 44*d*, there are provided the developing roller 44*a*, mixing roller 44*b*, and a top cover 44*e* for tightly shutting the developer D. It is noted that a mixer 44*f* is provided between the developing roller 44*a* and the mixing roller 44*b* so as to exchange carrier C, which is separated from the developing roller 44*a* after supplying toner T to the electrostatic latent image, for carrier C to which supply toner supplied from the mixing roller 44*b*.

Figure 4:
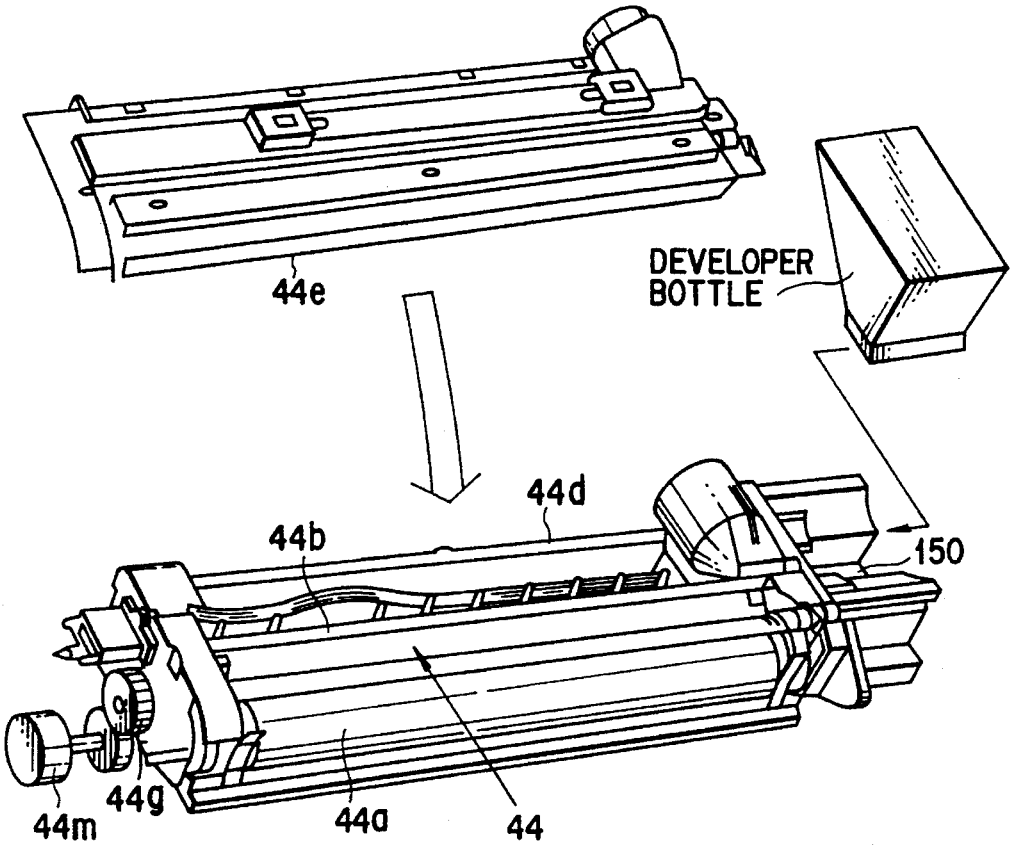
FIG. 4 is a schematic view showing a developer/toner supplying section of the developing unit of FIG. 3.

A developer/toner supply section 150 is provided at one end portion of the housing 44*d* (see FIG. 4) so that developer D or toner T can be supplied. Also, at the position where the rotation is transmitted from a developing motor 44*m*, that is, one end portion of the housing 44*d*, i.e., the end portion opposite to the developer/toner supply section 150, there is provided a power transmission gear 44*g* so as to rotate at least one of the mixer 44*f*, mixing roller 44*b*, and developing roller 44*a*. In a case that the FIG. 3 shows the state that the gear 44*g* is arranged in the mixer 44*f*.

Figure 5:
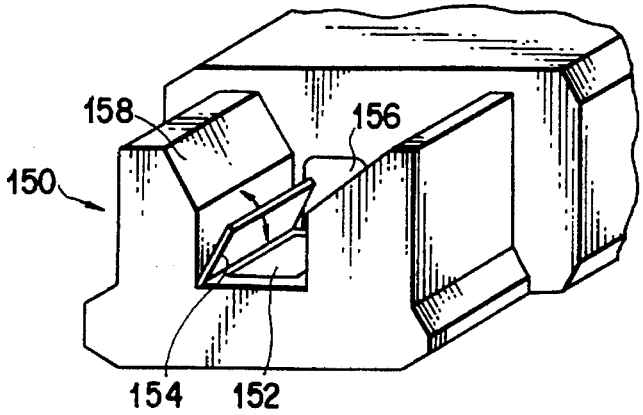
FIG. 5 is a schematic cross sectional view of the developing unit of FIG. 4.

In FIG. 5, the developer/toner supply section 150 includes a developer introduction inlet 152, a cover 154, a toner introduction inlet 156, and a tank/cartridge detachable guide 158. The inlet 152 is formed to be through a developer bottle (see FIG. 4) in which a mixer roller is contained. The cover 154 is formed to shield the inlet 152 and be connectable with a toner cartridge to be explained later. The inlet 156 is formed to be through a toner bottle (not shown). The guide 158 is formed such that either the developing tank for supplying developer D or the toner cartridge for supplying toner T is inserted thereto.

The cover 154 is swingable between the inlet 152 and the inlet 156 in a direction of an arrow. After developer D is introduced, the cover 154 is closed to shield the inlet 152 (the cover 154 is locked by lock mechanism, not shown), thereby prohibiting developer D from being erroneously introduced in spite of the fact that developer D is already introduced.

In a case that the developing tank is inserted, the space between the developing tank and the inlet 152 is maintained to a minimum (preferably the cover 154 pressurizes the tank). In a case that the toner cartridge is inserted, the space between the toner cartridge and the inlet 156 is maintained to a minimum (preferably the position where the cartridge is not prevented from being inserted into the inlet 156).

Figure 6:
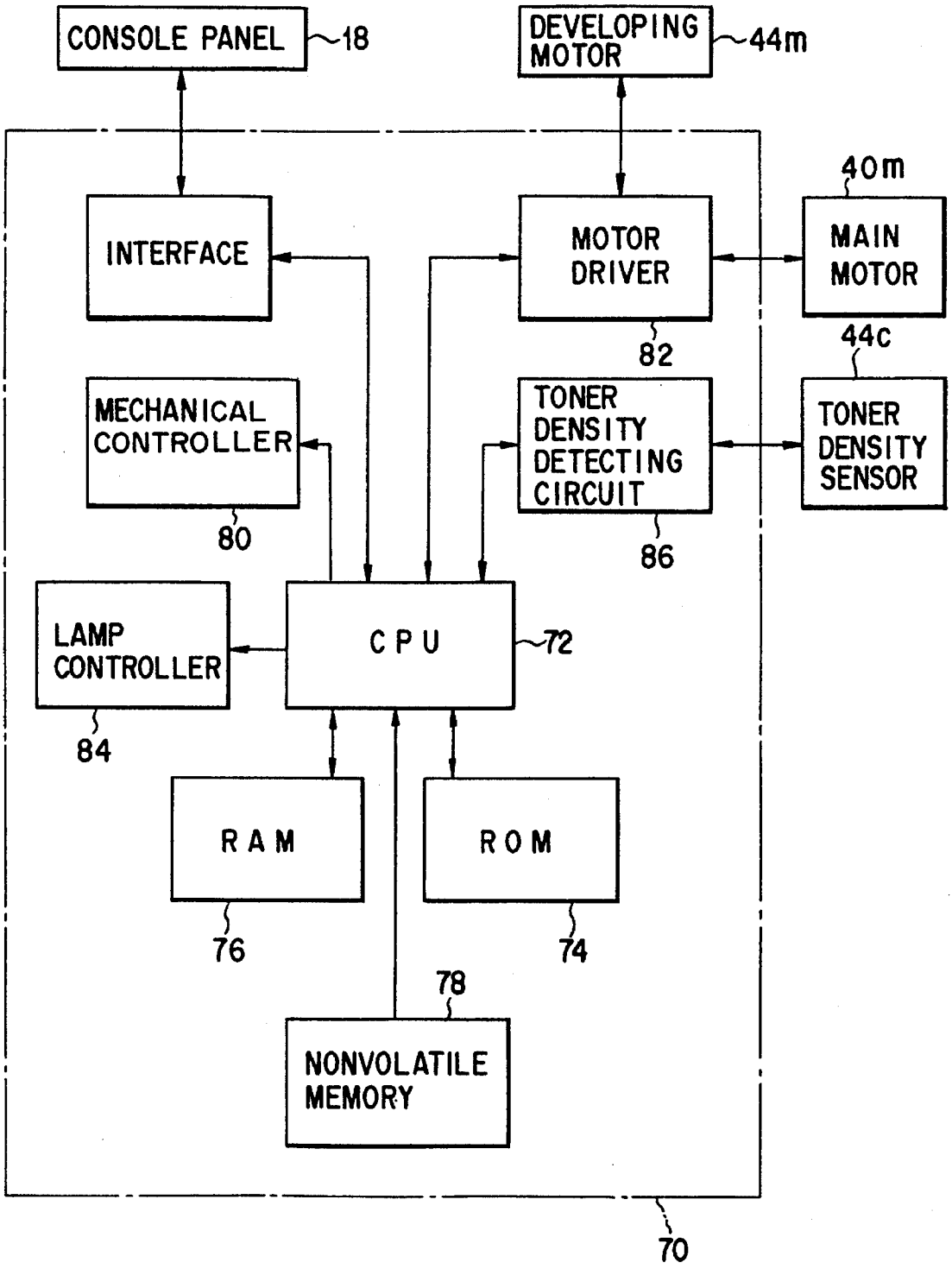
FIG. 6 is a schematic cross sectional view showing the copying machine shown in FIGS. 1 to 5 and a control section for controlling the developing unit.

In FIG. 6, a main controller 70 for controlling the copying machine includes a ROM 74, a RAM 76, and a non-volatile memory 78. ROM 74 is connected to a CPU 72, and stores various rules for operating the copying machine 2. RAM 76 temporarily stores numeral data inputted from the console panel 18, e.g., the number of paper to be copied, a magnification, an operation made, or the like. The non-volatile memory 78 can write a flag $F_{LG}$ showing that developer D is drawn into the developing device 44 or data such as a history of the operation of each part of the copying machine 2. In the non-volatile memory 78, written data cannot be deleted even if power of the copying machine 2 is turned off.

A higher voltage outputting transformer (not shown), a mechanical controller 80, a pulse motor (not shown), a motor driving circuit 82, a lamp regulator unit 84, and a toner density detecting circuit 86 are connected to CPU 72.

The higher voltage outputting transformer provides a desired voltage to the charging device 42 and the transfer unit 46. The mechanical controller 80 is used to urge a plurality of switches for detecting the position of paper P and the residual of papers in the cassette, and the mechanical section such as a solenoid. The motor driving circuit 82 is used to control the developing motor **44*m*, which rotates at least one of the mixer 44*f* and the developing roller 44*a*, and the main motor 40*m*, and the conveyor unit 56. The lamp regulator unit 84 is used to turn on the illumination lamp 22 and the fixing heater lamp (not shown) of the fixing unit 58. The toner density detecting circuit 86 detects the density of toner T and the presence of developer D from the output signal sent from a toner density sensor 146*a* attached to a top cover 146 of the developing device 44**.

Figure 7:
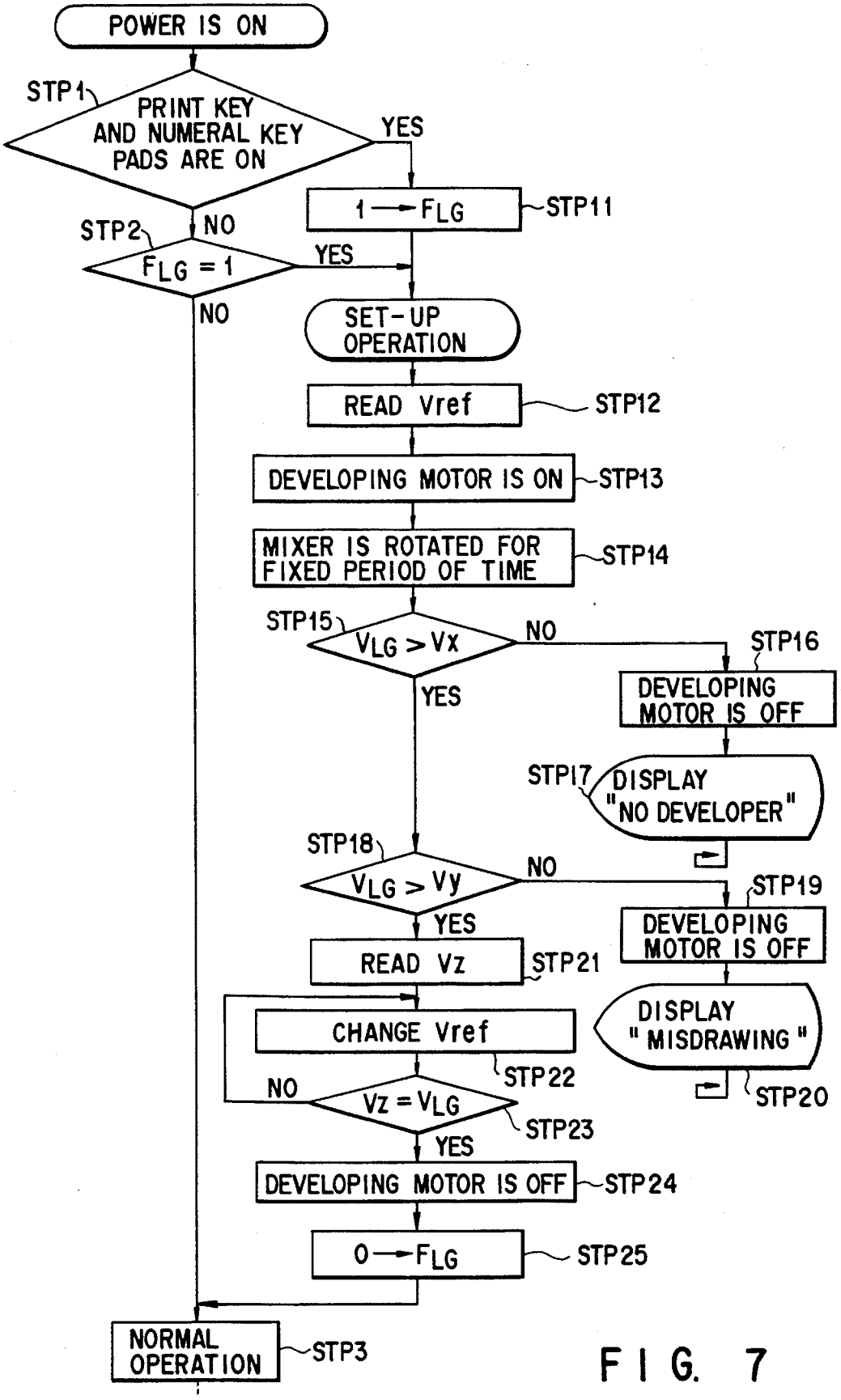
FIG. 7 is a flow chart showing one example of the control for drawing developer into the developing unit shown in FIGS. 3 to 5.

FIG. 7 is a flow chart showing that developer D is drawn into the developing device 44.

For example, a power switch (not shown) of the copying machine 2 is turned on in a state that "5" key of the numeric key pad **18*b* and the print key 18*a* of the console panel 18 are depressed at the same time. Thereby, the set-up mode (service mode) is set (STP1). In a case that the set-up mode is not set, the set-up operation stored in ROM 74 is executed, so that "1" or "0" is set in the flag $F_{LG}$, which is stored in the desired address of the memory 78 and which shows whether or not developer D is already drawn (STP2**).

In step STP2, in a case that flag $F_{LG}$ "0", it is discriminated that developer D is already contained in the housing **44*d* of the developing device 44. Then, the normal initial (warm-up) operation is executed, and a state that the copying operation can be performed is set (STP3**).

On the other hand, in a case that the set-up mode is set in STP1, "1" is set in flag $F_{LG}$ stored in the desired address of the memory 78 (STP11).

In step STP2, in the case that flag $F_{LG}$ is "1" and the case that the set-up mode is set in step STP1, thereby "1" is set in flag $F_{LG}$ through step STP11, it is discriminated that developer D is not drawn in the developing device 44, and the developer drawing operation is started.

In the set-up operation, the toner density sensor **44*c* is first operated. Due to this, the voltage to be applied to the sensor 44*c*, that is, reference voltage Vref [V] is read from ROM 74 (STP12**).

Then, the developing motor **44*m* is driven, and the mixer 44*f* is rotated in a desired direction by the mixer driving gear 44*g*, and developer D is drawn in the housing 44*d* (STP13**).

Sequentially, the mixer **44*f* (motor 44*m*) is rotated for a predetermined time, that is, a period of time, which is necessary for surely drawing developer D into the housing 44*d*, for example, 1 [min.] (STP14**).

The voltage $V_{LG}$ [V], which is outputted from the toner density sensor **44*c*, and the voltage Vx [V] (see FIG. 8) showing the case that the predetermined developer does not exist, are compared with each other (STP15**).

In the case that the output voltage $V_{LG}$ [V] outputted from the toner density sensor 44c is smaller than the voltage Vx [V] in step STP15, it is discriminated that developer D is not supplied and the developing motor **44*m* is turned off (STP16). Thereafter, a message, which shows that the developing tank is not provided, is displayed on the display 18*c* of the console panel 18 (STP17**).

On the other hand (STP15-Yes), in the case that the output voltage $V_{LG}$ [V] and the voltage Vy [V] which shows the defective of developer drawing (larger than the voltage Vx [V]) are compared with each other (STP18).

Then, in the case that the output voltage $V_{LG}$ [V] outputted from the toner density sensor **44*c* is smaller than the voltage Vy [V], it is discriminated that developer drawing is defective, and the developing motor 44*m* is turned off (STP19). Thereafter, a message, which shows the defective of developer drawing, is displayed on the display 18*e* of the console panel 18 (STP20**).

On the other hand (STP18-Yes), in the case that the output voltage $V_{LG}$ [V] outputted from the toner density sensor **44*c* is larger than the voltage Vy [V], it is discriminated that the entire amount of developer D is drawn, and sensitivity of the toner density sensor 44*c* to the drawn developer D is adjusted in steps STP21 to STP23**.

More specifically, if the sensor output $V_{LG}[V_1$ varies, a voltage Vz [V], which is used as a standard value for detecting that the toner density is changed, is read from ROM 74 (STP21). In other words, the toner density of the drawn developer D is correctly conformed to the predetermined density. Due to this, the reference voltage Vref [V], which is set based on the toner density of the drawn developer D in step STP12, is changed conform to the voltage Vz [V], which is the central value of the control curve in which the output voltage $V_{LG}$ [V] sent from the toner density sensor **146*a* is predetermined (STP22). Sequentially, it is checked whether $Vz=V_{LG}$ based on the changed Vref [V], and Vref [V] is changed till $Vz=V_{LG}$ is attained (STP23**).

Thereafter, the developing motor **44*m* is stopped (STP24), the end of the set-up is checked, and "0" is stored in the flag $F_{LG}$ of the non-volatile memory 78 (STP25**).

In step STP25, in the case that the output voltage Vz [V] of the toner density sensor **44*c* is largely changed when the power switch of the copying machine 2 is turned off, or the power failure occurs or the abnormal operation explained in steps STP15 and STP18** is detected, the flag $F_{LG}$ is maintained to be "1." Thereby, the set-up is newly started at the time when the power switch is turned on again, the power failure is restored, or the set-up mode is set.

Figure 8:
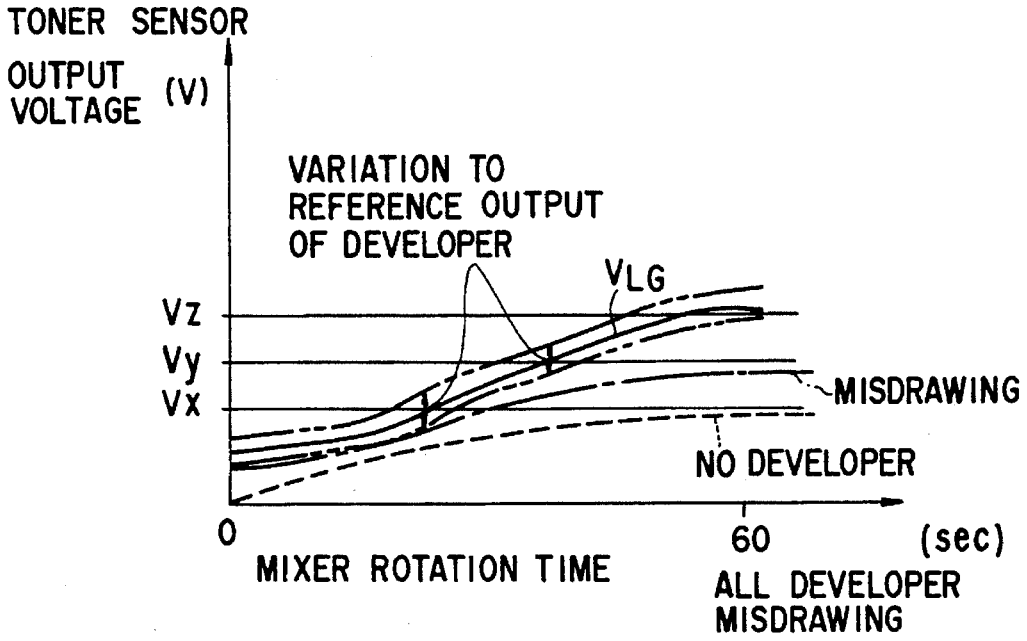
FIG. 8 is a graph showing an output voltage outputted from a toner density sensor of the developing unit shown in FIGS. 3 to 5.

FIG. 8 shows the relationship among the output voltage $V_{LG}$ [V], which is outputted from the toner density sensor **44*c* in steps STP15 and STP18 of FIG. 7, the voltage Vx [V], which shows the case that there is no developer D, and the voltage Vy [V], which shows drawing defective of developer D. More specifically, if the output voltage $V_{LG}$ [V] sent from the toner density sensor 44*c* is less than the voltage Vx [V] when the mixer 44*b*** is rotated for a predetermined period of time, it is possible to detect that there is no developer D. Similarly, if the output voltage $V_{LG}$ [V] is less than the voltage Vy [V], it is possible to detect the drawing defective.

In this case, the output voltage $V_{LG}$ [V] outputted from the toner density sensor **44*c*** includes a variation to the reference output of developer. The range of the variation between the upper and lower limit values is relatively large. Due to this, the difference between the voltage Vx [V] and the voltage Vy [V] is defined in accordance with the range between the upper and lower limit values of the output voltage $V_{LG}$ [V].

Figure 9:
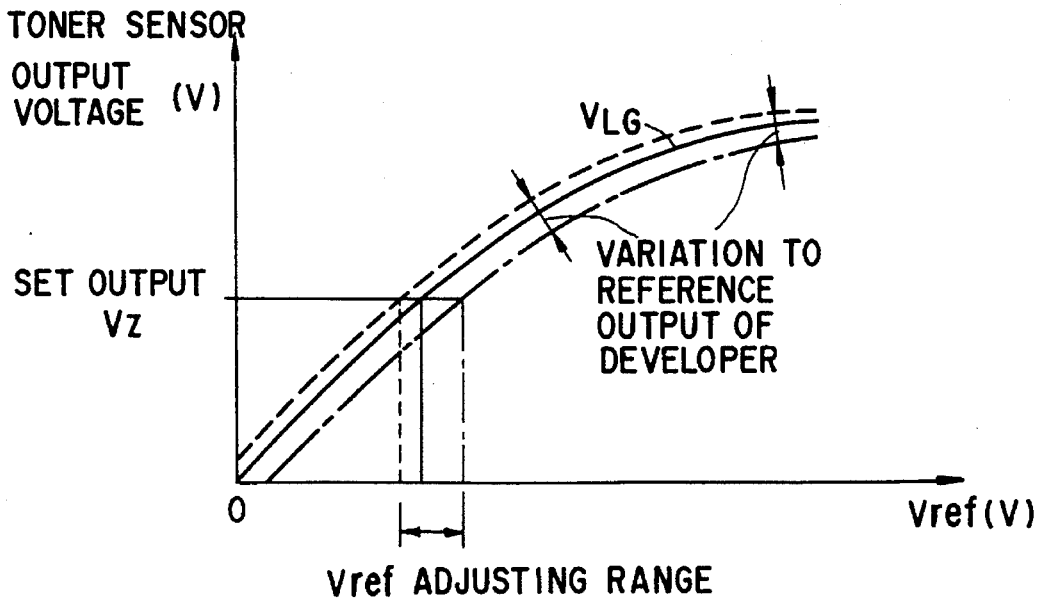
FIG. 9 is a graph showing an allowable range of the reference value of the voltage outputted from the toner density sensor of the developing unit shown in FIGS. 3 to 5.

FIG. 9 shows the relationship between the output voltage $V_{LG}$ [V] of the toner density sensor **44*c* to the developer D drawn into the housing 44*d* by the mixer 44*b* of the developing device 44** and the predetermined voltage Vz [V]. More specifically, if the output voltage $V_{LG}$ [V] of the toner density sensor exceeds the voltage Vy [V], it is detected the entire amount of developer D is drawn. Thereby, the reference voltage Vref [V] is changed based on the toner density of the drawn developer D such that the value of the output voltage $V_{LG}$ [V] is set to be an intermediate value between the upper and lower limit values. In other words, the pre-determined amount of toner can be supplied in accordance with the variation of the toner density, and $Vz=V_{LG}$ can be satisfied.

As mentioned above, $Vz=V_{LG}$ is satisfied, so that the predetermined amount of toner is correctly supplied to the developer having any initial properties regardless of the variation to the reference output of developer of the initial developer (drawn developer).

The following will explain the operation of the copy machine 2 in detail.

The document D (object) is mounted on the document table 10, and the number of paper to be copied and the magnification is set by the depression of the numeric key pad 18*b* of the console panel 18.

The print key 18*a* is turned on, so that the illumination lamp 22 is turned on, and the pulse motor (not shown) is urged, and the first carriage 20 and second carriage 30 are moved along the document D. Thereby, the reflected light from the document D, i.e., image data is guided to the photoconductive drum 40 through the lens 36, which is moved to the position corresponding to the set magnification.

The reflected light, which is guided to the photoconductive drum, forms the electrostatic latent image on the photoconductive drum 40 on which the desired potential is applied by the charging unit 42. The electrostatic latent image is developed by toner T supplied from the developing device 44, and transferred onto paper P as a toner image by use of the transfer unit 46.

Paper P on which the toner image is transferred is separated from the electrostatic absorption with the photoconductive drum 40, and transported to the fixing device 58 by the conveyor unit 56, and toner T is adhered to paper P by the fixing device 58.

Paper P to which toner T is adhered is discharged to the discharge tray 16 (or a sorter (not shown)) arranged in the outer unit of the copying machine 2.

As explained above, in the developing device 44 incorporated into the copying machine 2, when the set-up is performed, the developing tank is mounted on the tank/cartridge detachable guide 158 arranged in the developer/toner supplying section 150. Thereafter, the mixer 44*c* is rotated, so that developer D is drawn into the predetermined position of the housing 44*d*. In this case, the presence of the developer D and the drawing defective of the developer D are detected. Moreover, the output voltage outputted from the toner density sensor 44*c* is corrected based on the toner density peculiar to the developer D after the developer D is drawn. As a result, the image density of the copy image outputted from the copying machine 2 is stably maintained.

According to the copying machine of the present invention, the developing device and its surroundings can be prevented from becoming dirty due to the set-up operation for supplying the developer to the developing housing.

Also, it can be easily detected by the output from the toner density sensor arranged in the housing whether or not the developer is contained in the developing housing.

Moreover, even if the power failure occurs or the developing tank is not mounted in supplying the developer to the developing housing, the set-up can be surely performed.

Therefore, the efficiency of the set-up operation can be improved, and the service cost can be reduced.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus, comprising:

an image bearing member on which an electrostatic latent image corresponding to image information is formed;

means for developing the latent image by supplying toner particles onto the latent image formed on said image bearing member;

means for supplying carrier particles from an outer section of said developing means, the carrier particles for carrying the toner particles to the latent image on said image bearing member, said carrier particles providing a predetermined potential voltage to the toner particles;

means, arranged in said developing means, for monitoring a ratio of said carrier particles to the toner particles in said developing means and outputting a signal in accordance with said ratio; and means for sensing an amount of said carrier particles supplied from the outer section of said developing means based on the signal outputted from said monitoring means.

2. The apparatus according to claim 1, wherein said sensing means outputs a reference output voltage when said carrier particles and the toner particles are mixed with each other at a predetermined ratio and stirred for a predetermined period of time in a state that a predetermined amount of a mixture of said carrier particles and said toner particles is supplied into said developing means.

3. The apparatus according to claim 2, wherein said sensing means varies the level of the reference output voltage when the predetermined ratio is changed, and the amount of the toner particles is varied.

4. The apparatus according to claim 2, wherein said sensing means outputs a warning voltage having a different level from the reference output voltage when the amount of the toner particles and said carrier particles is less than the predetermined amount.

5. The apparatus according to claim 2, further comprising:

means for informing that a predetermined amount of the mixture of said carrier particles and the toner particles is supplied to said developing means in a state that said carrier particles and the toner particles are mixed with each other at the predetermined ratio when the reference output voltage is obtained; and means for storing a result informed by said informing means.

6. The apparatus according to claim 4, further comprising:

means for displaying that the warning voltage is outputted.

7. The apparatus according to claim 1, further comprising:

drawing means, integrally provided in said developing means, for drawing said carrier particles to said developing means from the outer section.

8. The apparatus according to claim 7, further comprising:

output means for outputting an instruction for urging said drawing means to be driven again when the predetermined amount of said carrier particles is not drawn in said developing means.

9. An image forming apparatus, comprising:

an image bearing member;

means for forming an electrostatic latent image on said image bearing member;

housing means for containing a developing member in which carrier particles and toner particles are mixed at a predetermined ratio;

a first opening means, provided in said housing means, for supplying the developing member;

a second opening means, provided in said housing means, for supplying only the toner particles;

means, provided in said housing means, for developing said electrostatic latent image by supplying the toner particles to said image bearing member;

means for leading the developing member into said housing means through said first opening means;

means, mounted in said housing means, for detecting whether or not all of the developing member is led to said housing means after said leading means is driven for a predetermined period of time; and means for urging said leading means to be driven again when said detecting means detects that all of the developing member is not led to said housing means.

10. The apparatus according to claim 9, further comprising:

means for sensing an amount of said carrier particles supplied through the first opening means.

11. An image forming apparatus, comprising:

means for forming a latent image on an image bearing member;

means for developing the latent image by applying toner particles to the latent image formed on the image bearing member by said forming means, said developing means having an inlet portion for introducing a developing member having a predetermined mixing ratio of the toner particles and carrier particles;

means for detecting the mixing ratio of the developing member introduced in said developing means;

a toner cartridge for adding toner particles stored therein, the toner cartridge being detachably connected to said developing means;

setup mode setting means for setting a setup mode in which the developing member is introduced;

setup mode control means for executing the setup mode when said setup mode setting means is activated, and stopping the setup mode in response to a detection result of the mixing ratio by said detecting means; and toner density control means for controlling a density of the toner particles in the developing member, said density control means being operable when the setup mode is not designated, and adding the toner particles contained in said toner cartridge to the developing member, thus maintaining the density of the toner particles of the developing member introduced in said developing means, in accordance with the detection result of said detecting means.

12. An image forming apparatus, comprising:

an image bearing member on which an electrostatic latent image corresponding to image information is formed;

means for developing the latent image by supplying toner particles onto the latent image formed on said image bearing member;

means for supplying carrier particles from an outer section of said developing means, the carrier particles for carrying the toner particles to the latent image on said image bearing member, said carrier particles providing a predetermined potential voltage to the toner particles;

means, arranged in said developing means, for monitoring a ratio of said carrier particles to the toner particles of said developing means and outputting a signal in accordance with said ratio;

means for sensing an amount of a mixture of the carrier particles and the toner particles supplied from the outer section of said developing means based on the signal outputted from said monitoring means; and controlling means for comparing an output value V1 provided from said sensing means after said mixture is drawn to the image bearing member for a predetermined period of time with a further output value V2 provided from said sensing means when said mixture is absent and determining that a developing member cartridge is not mounted under a condition that V1 is smaller than V2 (V1<V2), said controlling means comparing said output value V1 with a reference density value V3 of said mixture and further drawing said mixture to said developing means for a second predetermined period of time under a condition that V1 is smaller than V3 (V1<V3), said controlling means determining that an operation of drawing said mixture is incomplete and stopping the apparatus under a condition that V1 is smaller than V3 (V1<V3), and determining that said operation is completed properly and storing the output value V1 as a new reference value under a condition that V1 is larger than V3 (V1>V3), and said controlling means setting a flag when the controlling means determines that said operation is completed, and otherwise selecting a setup mode to supply said mixture to the image bearing member when the apparatus is restarted.

* * * * *